US007044712B2

(12) United States Patent
Cho et al.

(10) Patent No.: US 7,044,712 B2
(45) Date of Patent: May 16, 2006

(54) AXIAL-FLOW FAN

(75) Inventors: Kyungseok Cho, Daejeon-si (KR); Seyoung Park, Daejeon-si (KR); Changho Park, Daejeon-si (KR)

(73) Assignee: Halla Climate Control Corporation, Daejeon-si (KR)

( * ) Notice: Subject to any disclaimer, the term of this patent is extended or adjusted under 35 U.S.C. 154(b) by 128 days.

(21) Appl. No.: 10/791,738

(22) Filed: Mar. 4, 2004

(65) Prior Publication Data

US 2004/0175269 A1 Sep. 9, 2004

(30) Foreign Application Priority Data

Mar. 5, 2003 (KR) ..... 2003-0013767

(51) Int. Cl.
*F04D 29/38* (2006.01)

(52) U.S. Cl. ..... 416/169 A; 416/238

(58) Field of Classification Search ..... 416/234, 416/238, 169 A, 242, 243
See application file for complete search history.

(56) References Cited

U.S. PATENT DOCUMENTS 5,312,230 A * 5/1994 Oda et al. ..... 416/234
6,027,307 A * 2/2000 Cho et al. ..... 416/169 A
6,394,754 B1 5/2002 Choi
6,447,251 B1 9/2002 Zeng
6,908,287 B1 6/2005 Cho et al.
2002/0034443 A1 3/2002 Song
2003/0012656 A1* 1/2003 Cho et al. ..... 416/235

FOREIGN PATENT DOCUMENTS

EP 0 282 074 A2 9/1988
EP 1 083 391 A2 3/2001

* cited by examiner

*Primary Examiner*—Edward K. Look
*Assistant Examiner*—Richard A. Edgar
(74) *Attorney, Agent, or Firm*—Nixon Peabody LLP; Jeffery L. Costellia

(57) ABSTRACT

This present invention relates to an axial-flow fan including a central hub connected with a driving shaft of a motor, and a plurality of blades extending radially along the circumference of the hub for blowing air toward an axial direction, the plurality of blades integrated with the hub into a single body, wherein assuming that a camber ratio at a blade root(cr1) of each blade is the value obtained by dividing a maximum camber value at the blade root into a chord length, a camber ratio at a blade tip(cr2) of each blade is the value obtained by dividing a maximum camber value at the blade tip into the chord length, and a percentage of decrease of the camber ratio is the value obtained by dividing a difference value between the camber ratio at the blade root(cr1) and the camber ratio at the blade tip(cr2) into the camber ratio at the blade root(cr1), the percentage of decrease of the camber ratio is in a range between 33% and 85%.

12 Claims, 6 Drawing Sheets

AXIAL-FLOW FAN

BACKGROUND OF THE INVENTION

1. Field of the Invention

The present invention relates to an axial-flow fan, and more particularly, to an axial-flow fan that can reduce the camber ratios of blades up to a range between 33% and 85%, thereby achieving a very low noise level.

2. Background of the Related Art

An axial-flow fan includes a circular central hub and a plurality of blades radially arranged along the circumference of the hub, and as well known those skilled in the art, the axial-flow fan is a kind of fluid machinery and serves to blow air in the axial direction by the rotation of the plurality of the blades. A representative example of the axial-flow fan is a cooling fan that promotes heat radiation of an air-cooled heat exchanger, such as an electric fan, a ventilation fan, and a radiator or condenser of an automobile, by blowing air to or drawing air from the heat exchanger.

The axial-flow fan that is used as the cooling fan of the heat exchanger in the air conditioning system of the automobile is mounted in the rear or front of the heat exchanger in conjunction with a shroud that is provided with a plurality of airflow guide vanes that serve to guide the air blown by the blades of the fan to an axial direction from the front or the rear of the heat exchanger. The axial-flow fan may be classified into a pusher-type axial-flow fan assembly and a puller-type axial-flow fan assembly in accordance with the arranged positions with respect to the heat exchanger.

As shown in FIGS. 1 and 2, the general axial-flow fan 1 of an automobile is mounted in conjunction with a shroud 2 surrounding the blades of the fan and guiding air toward the axial direction, in the front of the heat exchanger. The axial-flow fan 1 includes a central hub 12 connected with the driving shaft of a motor 3, a plurality of blades 11 extending radially outwardly from the hub 12, and a circular fan band 13 to which the peripheral ends of the plurality of blades 11 are fixed for surrounding the plurality of blades 11. The axial-flow fan is generally made of synthetic resin and integrated with the blades 11 into a single body. The plurality of blades 11 that are curved in the plane of the fan 1 are rotated as the motor 3 is rotated, thereby producing a difference pressure of the airflow velocity between the front and rear of the fan. Thus, the axial-flow fan blows air to the axial direction.

Therefore, the plurality of blades 11 can give lots of influences to the airflow efficiency and the generation of noise in the axial-flow fan 1. As shown in FIG. 5 showing the terms used to describe the blades 11 of the axial-flow fan 1 are defined, the axial-flow fan 1 should be designed optimally with a variety of blade designing factors, such as setting angle of the blades 11, camber ratio, cross-directional curvature, chord length and axial-directional inclination angle.

The camber ratio is obtained by dividing a maximum camber value into a chord length.

The setting angle is obtained by subtracting a stagger angle at which each blade 11 is erected from 90 degree.

Among the afore-described designing factors, herein, the setting angle and the camber ratio should be determined with great care.

As shown in FIGS. 5 and 6, the setting angle in the prior art is formed in such a way that it is constant from an intermediate region of each blade to a blade tip and decreases at a blade root, and the camber ratio decreases toward the blade tip from the hub 12. In this case, the percentage of decrease of the camber ratio is not over 30%.

According to the blade designing factors in the prior art, by the way, they exhibit the limits in suppressing the airflow noise generation during the rotation of the blades 11.

SUMMARY OF THE INVENTION

Accordingly, the present invention has been made in view of the above-mentioned problems occurring in the prior art.

An object of the present invention is to provide an axial-flow fan that can reduce the camber ratios of a plurality of blades up to a range between 33% and 85%, thereby achieving a very low noise level.

According to an aspect of the present invention, there is provided an axial-flow fan comprising a central hub connected with a driving shaft of a motor and a plurality of blades extending radially along the circumference of the hub for blowing air toward an axial direction, the plurality of blades integrated with the hub into a single body, wherein assuming that a camber ratio at a blade root(cr1) of each blade is the value obtained by dividing a maximum camber value at the blade root into a chord length, a camber ratio at a blade tip(cr2) of each blade is the value obtained by dividing a maximum camber value at the blade tip into the chord length, and a percentage of decrease of the camber ratio is the value obtained by dividing a difference value between the camber ratio at the blade root(cr1) and the camber ratio at the blade tip(cr2) by the camber ratio at the blade root(cr1), the percentage of decrease of the camber ratio is in a range between 33% and 85%.

According to another aspect of the present invention, there is provided an axial-flow fan having a central hub connected with a driving shaft of a motor and a plurality of blades extending radially along the circumference of the hub 12 for blowing air toward an axial direction, the plurality of blades integrated with the hub into a single body, wherein each blade has a backward sweep angle at the blade root thereof and a forward sweep angle at the blade tip thereof, while having an airflow distributing region that is defined by a plurality of small regions where sweep angles are changed in turn formed on a region between the backward sweep angle region and the forward sweep angle region, and wherein assuming that a camber ratio at the blade root(cr1) of each blade is the value obtained by dividing a maximum camber value at the blade root into a chord length, a camber ratio at the blade tip(cr2) of each blade is the value obtained by dividing a maximum camber value at the blade tip into the chord length, and a percentage of decrease of the camber ratio is the value obtained by dividing a difference value between the camber ratio at the blade root(cr1) and the camber ratio at the blade tip(cr2) by the camber ratio at the blade root(cr1), the percentage of decrease of the camber ratio is in a range between 33% and 85%.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 3:
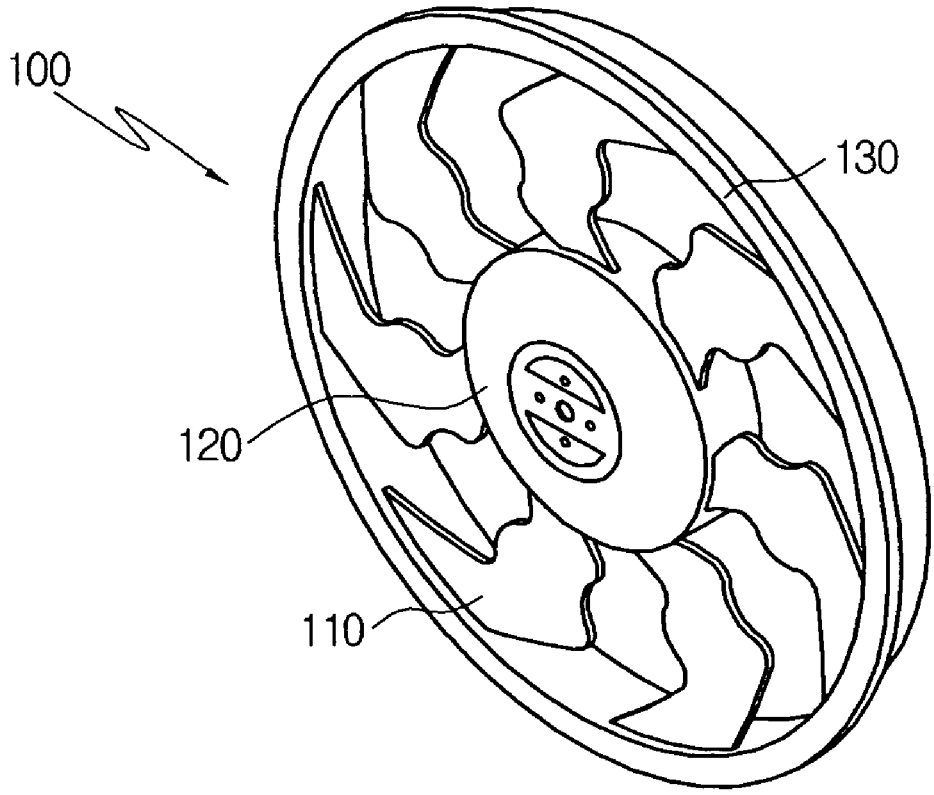
FIG. 3 is a perspective view of the outer appearance of the axial-flow fan according to the present invention.
Figure 4:
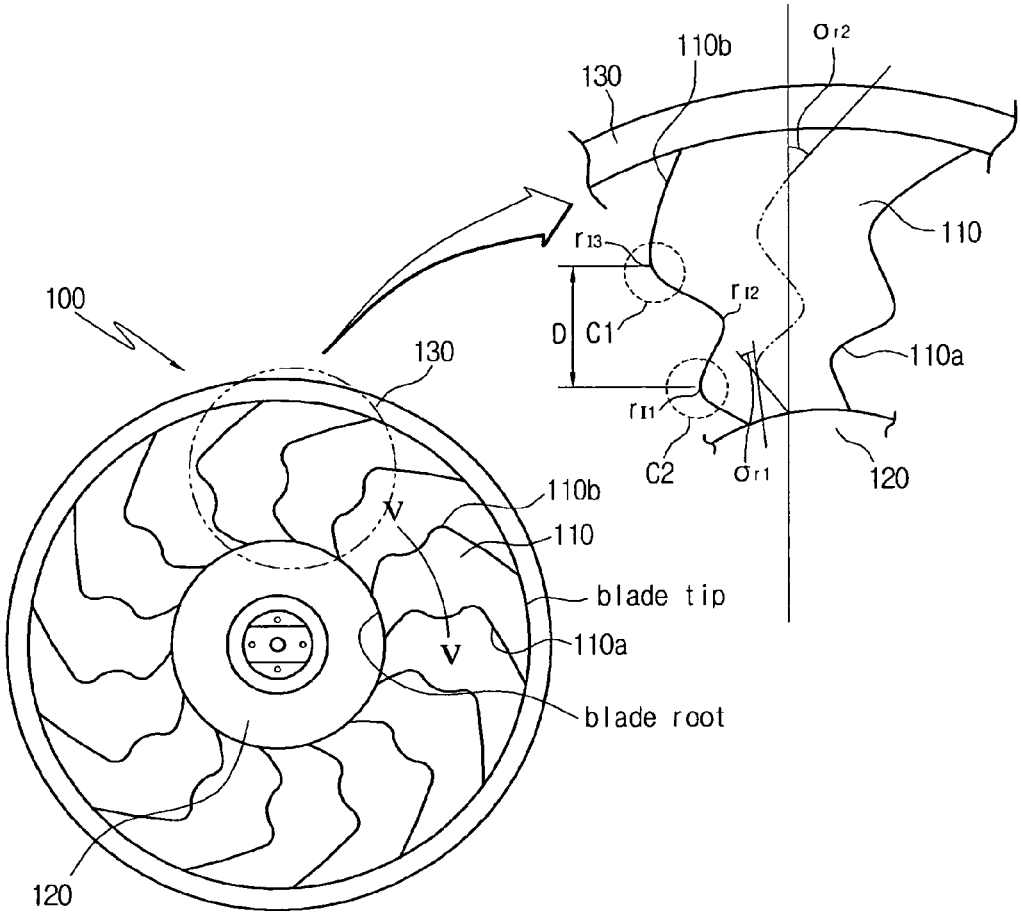
FIG. 4 is a front view of the axial-flow fan of the present invention.
Figure 5:
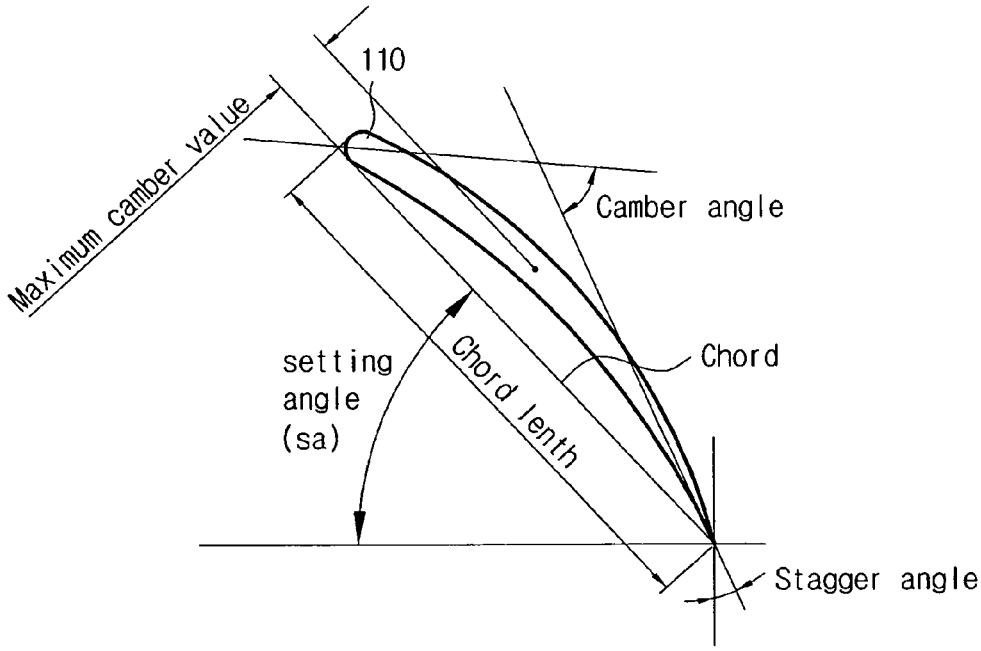
FIG. 5 is a sectional view taken along the line V-V shown in FIG. 4, wherein the terms used to describe the blades of the axial-flow fan are defined.
Figure 6:
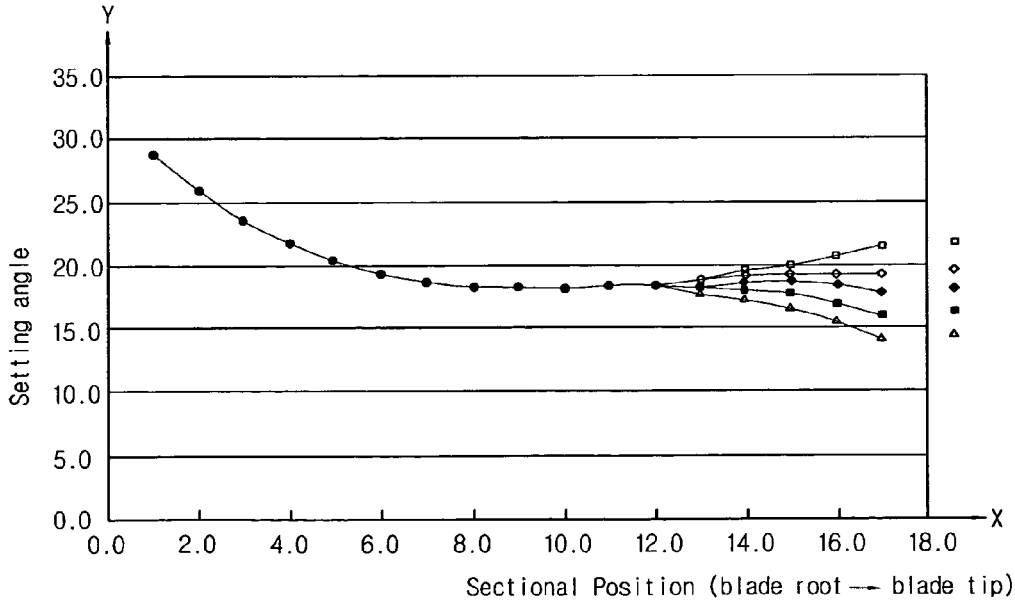
FIG. 6 is a graph showing the changes of the setting angle in the axial-flow fan of the present invention.
Figure 7:
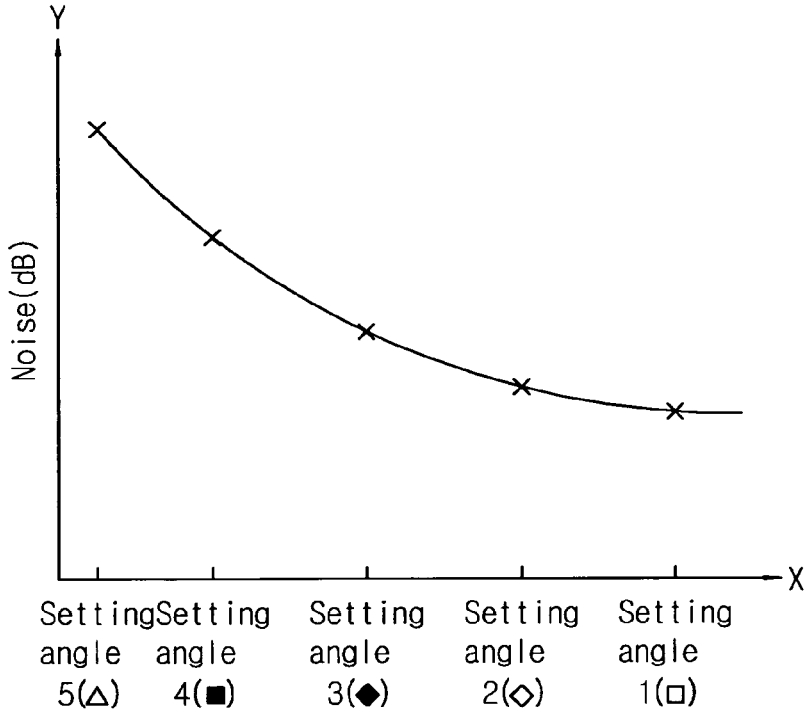
FIG. 7 is a graph comparing the degrees of noise of the prior art and the present invention with respect to the setting angle of the present invention.
Figure 8:
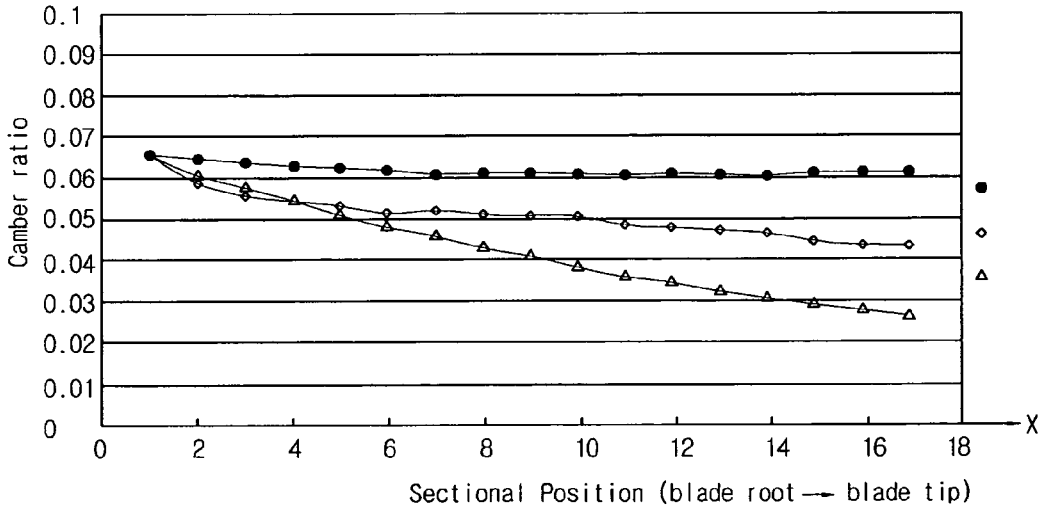
FIG. 8 is a graph showing the changes of camber ratio in the axial-flow fan of the present invention.
Figure 9:
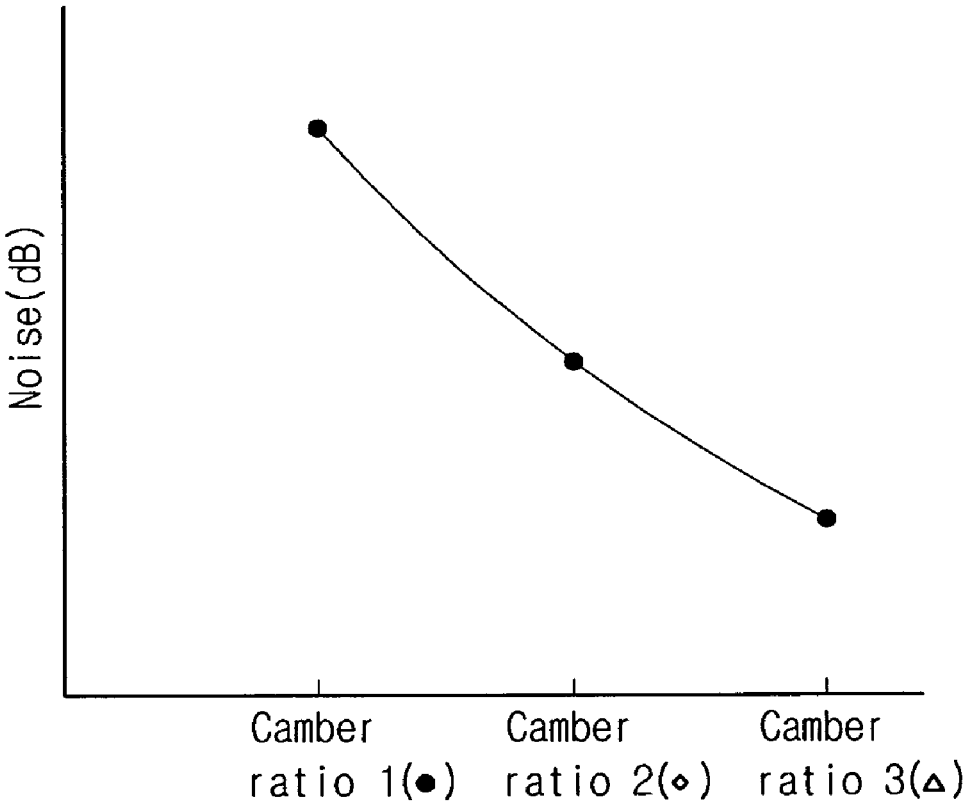
FIG. 9 is a graph showing the degree of noises with respect to the camber ratios in the axial-flow fan of the present invention when air volume is the same.

FIG. 3 is a perspective view of the outer appearance of the axial-flow fan according to the present invention, FIG. 4 is a front view of the axial-flow fan of the present invention, FIG. 5 is a sectional view taken along the line V—V shown in FIG. 4, wherein the terms used to describe the blades of the axial-flow fan are defined, FIG. 6 is a graph showing the changes of the setting angle in the axial-flow fan of the present invention, FIG. 7 is a graph comparing the degrees of noise of the prior art and the present invention with respect to the setting angle of the present invention, FIG. 8 is a graph showing the changes of camber ratio in the axial-flow fan of the present invention, and FIG. 9 is a graph showing the degree of noises with respect to the camber ratios in the axial-flow fan of the present invention when air volume is the same.

The axial-flow fan 100 of the present invention includes a central hub 120 connected with a driving shaft of a motor (not shown), a plurality of blades 110 extending radially along the circumference of the hub 120 for blowing air toward an axial direction, the plurality of blades 110 integrated with the hub into a single body, and a circular fan band 130 to which the peripheral ends of the plurality of blades 110 are fixed for surrounding the plurality of blades 110.

Each of the plurality of blades 110 has a front peripheral side 110*a* and a rear peripheral side 110*b* that are formed in a shape of waveform.

The axial-flow fan 100 of the present invention may be applied to a pusher-type axial-flow fan assembly and a puller-type axial-flow fan assembly in accordance with the arranged positions with respect to the heat exchanger.

In the first embodiment of the present invention, assuming that a camber ratio at a blade root(cr1) of each blade 110 is the value obtained by dividing a maximum camber value at the blade root into a chord length, a camber ratio at a blade tip (cr2) of each blade 110 is the value obtained by dividing a maximum camber value at the blade tip into the chord length, and a percentage of decrease Δcr of the camber ratio is the value obtained by dividing a difference value between the camber ratio at the blade root(cr1) and the camber ratio at the blade tip(cr2) by the camber ratio at the blade root(cr1), the percentage of decrease Δcr of the camber ratio is in a range between 33% and 85%.

According to the present invention, the percentage of decrease Δcr of the camber ratio is preferably in a range between 50% and 70%.

The setting angle sa of each blade 110 increases from an intermediate region of each blade 110 to the blade tip.

The setting angle sa increases in a range between 2 degree and 8 degree at a smallest angle point.

The camber ratio at the blade root(cr1) of each blade 110 has a greatest value of 0.1 and the camber ratio at the blade tip(cr2) of each blade 110 has a smallest value of 0.01.

More preferably, the camber ratio at the blade root(cr1) of each blade 110 has a greatest value of 0.065 and the camber ratio at the blade tip(cr2) of each blade 110 has a smallest value of 0.025.

According to another embodiment of the present invention, each blade 110 has a backward sweep angle at the blade root thereof and a forward sweep angle at the blade tip thereof, and it also has an airflow distributing region that is defined by a plurality of small regions where sweep angles are changed in turn formed on a region between the backward sweep angle region and the forward sweep angle region.

In more detail, each blade is slanted in a direction opposite to the rotation at the blade root abutting the hub 120 and is slanted in a rotating direction at the blade tip. Thus, the sweep angle $\sigma_r$ is an angle between a tangent line extending from an arbitrary point on the leading edges line or trailing edges line of the blades 110, and a radius line extending from the center of the hub 120 through the arbitrary point. The sweep angle is backward (−) at the blade root and starts to be changed at a predetermined point toward the blade tip in such a way as to be forward (+) at the blade tip. That is to say, each blade has the backward sweep angle $\sigma_{r1}$ at the blade root portion and the forward sweep angle $\sigma_{r2}$ at the blade tip portion.

The leading edges line or trailing edges line have an airflow distributing region D where the sweep angle is changed from backward to the forward at a first turning point $r_{11}$, changed to the rear direction again at a second turning point $r_{12}$, and changed to the front direction again at a third turning point $r_{13}$, at the intermediate portion thereof.

Figure 1:
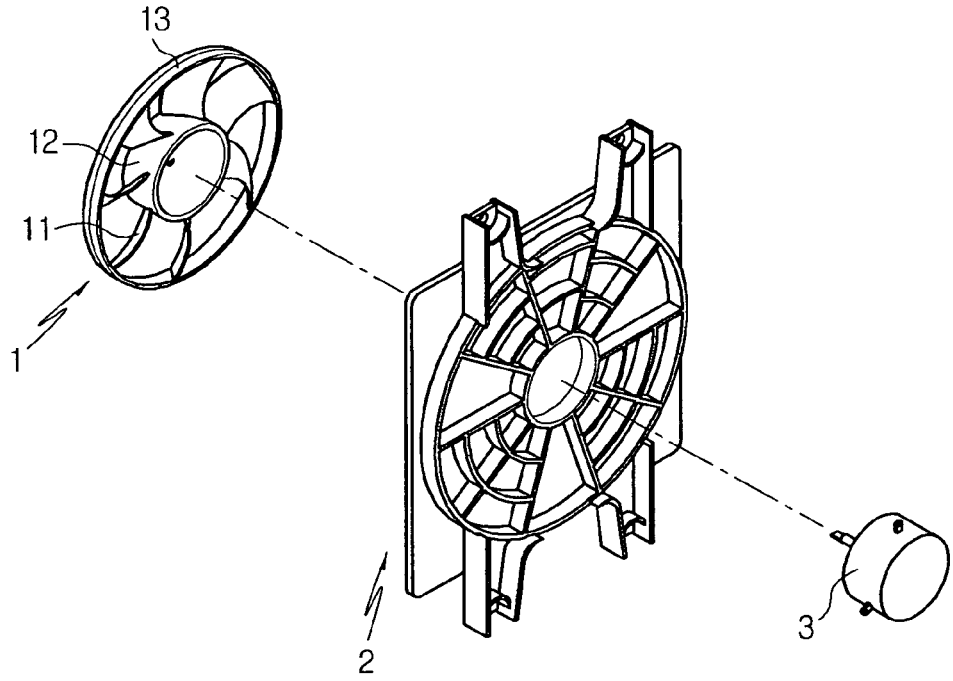
FIG. 1 is an exploded perspective view of a general axial-flow fan assembly.
Figure 2:
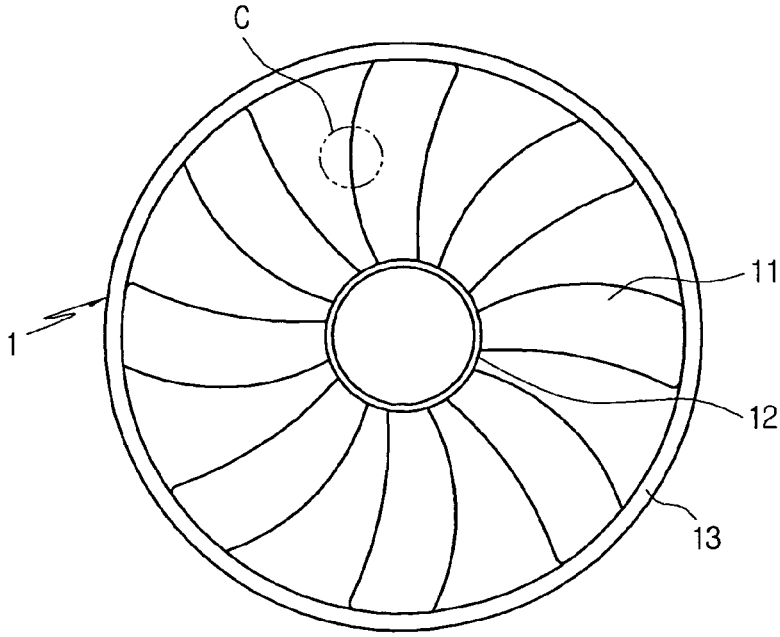
FIG. 2 is a front view of the axial-flow fan of FIG. 1.

The airflow distributing region D forms two airflow concentrating portions C1 and C2 at the rear peripheral side of each blade, and therefore, the axial-flow fan of the present invention can greatly suppress the collection of the airflow when compared with the conventional practice where a single airflow concentrating portion C is formed, as shown in FIG. 2.

On the other hand, assuming that a camber ratio at a blade root(cr1) of each blade is the value obtained by dividing a maximum camber value at the blade root into a chord length, a camber ratio at a blade tip(cr2) of each blade is the value obtained by dividing a maximum camber value at the blade tip into the chord length, and a percentage of decrease Δcr of the camber ratio is the value obtained by dividing a difference value between the camber ratio at the blade root(cr1) and the camber ratio at the blade tip(cr2) by the camber ratio at the blade root(cr1), the percentage of decrease Δcr of the camber ratio is in a range between 33% and 85%.

According to the present invention, the percentage of decrease Δcr of the camber ratio is preferably in a range between 50% and 70%.

The setting angle sa of each blade 110 increases from an intermediate region of each blade 110 to the blade tip.

The setting angle sa increases in a range between 2 degree and 8 degree at a smallest angle point.

The camber ratio at the blade root(cr1) of each blade 110 has a greatest value of 0.1 and the camber ratio at the blade tip(cr2) of each blade 110 has a smallest value of 0.01.

More preferably, the camber ratio at the blade root(cr1) of each blade 110 has a greatest value of 0.065 and the camber ratio at the blade tip(cr2) of each blade 110 has a smallest value of 0.025.

In this case, an axis X in FIG. 6 represents 17 sectional positions of each blade ranging from the blade root to the blade tip in a direction of a line V—V in FIG. 4, and an axis Y therein represents the setting angles, as shown in FIG. 5.

In more detail, the setting angle 1(□) represents the setting angle that increases from an intermediate region of the hub 120 to the blade tip of each blade 110, as appreciated from the embodiment of the present invention, the setting angle 2(◇) represents the setting angle that is approximately constant from an intermediate region of the hub 120 to the blade tip of each blade 110, and the setting angle 3(◆), the setting angle 4(■) and the setting angle 5(Δ) represent the setting angles that increase from an intermediate region of the hub 120 to the blade tip of each blade 110, as appreciated from the prior art.

In this case, an axis X in FIG. 8 represents 17 sectional positions of each blade ranging from the blade root to the blade tip in a direction of a line V—V in FIG. 4, and an axis Y therein represents the camber ratios, as shown in FIG. 5.

In more detail, ● represents the camber ratio embodied in the prior art that is approximately constant from the hub 120 to the blade tip of each blade 110, wherein the camber ratio is 0.06 to 0.07 in a full range.

◇ represents the camber ratio, which somewhat decreases from the hub 120 to the blade tip of each blade 110, wherein the camber ratio is in a range of 0.05 to 0.06.

Δ represents the camber ratio embodied in the present invention, which decreases greatly from the hub 120 to the blade tip of each blade 110, wherein the camber ratio is in a range of 0.065 to 0.025.

The setting angle of each blade is determined as described in the first and second embodiments of the present invention, and as shown in FIG. 7, the present invention can achieve a gradually lower noise level when compared with the prior art when the air volume is the same in the setting angle □. And the present invention generates relatively higher noise levels in accordance with the order of the setting angle 2◇, the setting angle 3(◆), the setting angle 4(■) and the setting angle 5(Δ).

Also, the percentage of decrease of the camber ratio of each blade is determined as described in the first and second embodiments of the present invention, and as shown in FIGS. 8 and 9, the present invention generates a gradually lower noise level in accordance with the order of the camber ratio 1●, the camber ratio 2◇ and the camber ratio 3Δ when the air volume is the same.

The optimal camber ratio Δ in the present invention generates a remarkably lower noise level, as shown in FIG. 9, when the air volume is the same.

As clearly described above, there is provided an axial-flow fan that can reduce the camber ratios of a plurality of blades up to a range between 33% and 85%, thereby achieving a very low noise level.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An axial-flow fan comprising:

a central hub connected with a driving shaft of a motor; and a plurality of blades extending radially along the circumference of the hub for blowing air toward an axial direction, the plurality of blades integrated with the hub into a single body, wherein assuming that a camber ratio at a blade root(cr1) of each blade is the value obtained by dividing a maximum camber value at the blade root(cr1) by a chord length, a camber ratio at a blade tip(cr2) of each blade is the value obtained by dividing a maximum camber value at the blade tip by the chord length, and a percentage of decrease of the camber ratio is the value obtained by dividing a difference value between the camber ratio at the blade root(cr1) and the camber ratio at the blade tip(cr2) by the camber ratio at the blade root(cr1), the percentage of decrease of the camber ratio is in a range between 33% and 85%, said camber ratio decreasing substantially proportionally along a length of each blade from said blade root toward said blade tip.

2. An axial-flow fan according to claim 1, wherein a setting angle of each blade increases from an intermediate region of each blade to the blade tip.

3. An axial-flow fan according to claim 2, wherein the setting angle increases in a range between 2 degree and 8 degree at a smallest angle point.

4. An axial-flow fan according to claim 1, wherein the camber ratio at the blade root(cr1) of each blade has a greatest value of 0.1 or the camber ratio at the blade tip(cr2) of each blade has a smallest value of 0.01.

5. An axial-flow fan according to claim 4, wherein the camber ratio at the blade root(cr1) of each blade has a greatest value of 0.065 and the camber ratio at the blade tip(cr2) of each blade has a smallest value of 0.025.

6. An axial-flow fan according to claim 1, wherein the percentage of decrease of the camber ratio is in a range between 50% and 70%.

7. An axial-flow fan comprising:

a central hub connected with a driving shaft of a motor; and a plurality of blades extending radially along the circumference of the hub for blowing air toward an axial direction, the plurality of blades integrated with the hub into a single body, wherein each blade his a backward sweep angle at the blade root thereof and a forward sweep angle at the blade tip thereof, while having an airflow distributing region that is defined by a plurality of small regions where sweep angles are changed in turn formed on a region between the backward sweep angle region and the forward sweep angle region, and wherein assuming that a camber ratio at the blade root (cr1) of each blade is the value obtained by dividing a maximum camber value at the blade root by a chord length, a camber ratio at the blade tip(cr2) of each blade is the value obtained by dividing a maximum camber value at the blade tip by the chord length, and a percentage of decrease of the camber ratio is the value obtained by dividing a difference value between the camber ratio at the blade root(cr1) and the camber ratio at the blade tip(cr2) by the camber ratio at the blade root(cr1), the percentage of decrease of the camber ratio is in a range between 33% and 85%, said camber ratio decreasing substantially proportionally along a length of each blade from said blade root toward said blade tip.

8. An axial-flow fan according to claim 7, wherein a setting angle of each blade increases from an intermediate region of each blade to the blade tip.

9. An axial-flow fan according to claim 8, wherein the setting angle increases in a range between 2 degree and 8 degree at a smallest angle point.

10. An axial-flow fan according to claim 7, wherein the camber ratio at the blade root of each blade has a greatest value of 0.1 or the camber ratio at the blade tip of each blade has a smallest value of 0.01.

11. An axial-flow fan according to claim 10, wherein the camber ratio at the blade root of each blade has a greatest value of 0.065 and the camber ratio at the blade tip of each blade has a smallest value of 0.025.

12. An axial-flow fan according to claim 7, wherein the percentage of decrease of the camber ratio is in a range between 50% and 70%.

* * * * *